US006035449A

United States Patent [19]

Galler et al.

[11] Patent Number: 6,035,449

[45] Date of Patent: Mar. 14, 2000

[54] MAGNETIC DETACHABLE POCKET

[76] Inventors: Raymond R. Galler; Randolph B. Galler; John S. Galler; Marguerite Wilson, all of 8144 U.S. Hwy. 90, Live Oak, Fla. 32060

[21] Appl. No.: 09/181,867

[22] Filed: Oct. 29, 1998

Related U.S. Application Data

[60] Provisional application No. 60/065,075, Nov. 10, 1997.

[51] Int. Cl.[7] ..... A41D 27/20

[52] U.S. Cl. ..... 2/249; 2/247; 2/251; 24/303

[58] Field of Search ..... 2/247, 249, 250, 2/251; 40/586, 600, 621, 124.04, 661.01, 426, 1.5, 1.6; 24/303

[56] References Cited

U.S. PATENT DOCUMENTS

| | | | |
|---|---|---|---|
| 2,591,059 | 4/1952 | Frohman | 2/247 |
| 3,611,444 | 10/1971 | Rector . | |
| 3,624,686 | 11/1971 | Beals . | |
| 3,747,776 | 7/1973 | Gross . | |
| 4,236,331 | 12/1980 | Mattson | 40/1.5 |
| 4,266,300 | 5/1981 | Patridge . | |
| 4,365,355 | 12/1982 | Off et al. . | |
| 4,602,390 | 7/1986 | Morera et al. . | |
| 4,899,395 | 2/1990 | Spector . | |
| 5,054,127 | 10/1991 | Zevchak . | |
| 5,274,937 | 1/1994 | Birnbaum | 40/600 |
| 5,347,733 | 9/1994 | Whittington | 40/1.5 |
| 5,468,152 | 11/1995 | Lenart . | |
| 5,617,587 | 4/1997 | Marchbanks | 2/247 |
| 5,901,372 | 5/1999 | Lawler | 2/69 |
| 5,920,966 | 7/1999 | Chen | 24/303 |
| 5,946,732 | 9/1999 | Richards | 2/247 |

FOREIGN PATENT DOCUMENTS

WO 86/07271 12/1986 WIPO .

*Primary Examiner*—John J. Calvert
*Assistant Examiner*—Tejash Patel
*Attorney, Agent, or Firm*—Richard C. Litman

[57] ABSTRACT

A pocket using opposing magnetic strips that may be repeatedly attached to and detached from either the inside or the outside of an article having a thin sheet wall (such as a piece of clothing, a hat, a portable bag, or decorative articles like holiday stockings). The detachable pocket includes a pair of fabric patches including strip magnets that are sewn into a hem around most of the periphery of each patch, forming a backless pouch. Each magnetized pouch so formed can thus be placed on opposing sides of the article and thereby form a detachable pouch on the inside and on the outside of the article. An alternative embodiment has a pocket pouch only on the outside of the article with a U-shaped magnetic member holding the outside pouch from the inside of the article. The outside pouch can be decorated in accordance with a seasonal theme permitting ordinary clothing and like articles to be decorated according to the holiday season.

7 Claims, 3 Drawing Sheets

MAGNETIC DETACHABLE POCKET

CROSS-REFERENCE TO RELATED APPLICATION

This application claims the benefit of U.S. Provisional Patent Application Ser. No. 60/065,075, filed Nov. 10, 1997.

BACKGROUND OF THE INVENTION

1. Field of the Invention

The present invention relates to pockets that may be repeatedly attached to and detached from a number of different clothing apparel articles.

2. Description of Related Art

Pockets that attach to and detach from clothing are known in the art and can be characterized by their uses and means of attachment. The following U.S. patents show pockets that attach to and detach from the outside of various articles of clothing: U.S. Pat. No. 3,624,686, issued to Jean A. Beals on Nov. 30, 1971; U.S. Pat. No. 3,747,776, issued to George E. Gross on Jul. 24, 1973; U.S. Pat. No. 4,266,300, issued to Aileen A. Partridge on May 12, 1981; and U.S. Pat. No. 5,054,127, issued to Eric S. Zevchak on Oct. 8, 1991. However, none of these inventions disclose means of attachment using magnets.

Other U.S. patents each show pockets that attach to and detach from the inside of various articles of clothing including U.S. Pat. No. 3,611,444, issued to Carl T. Rector on Oct. 12, 1971, and U.S. Pat. No. 4,899,395, issued to Donald Spector on Feb. 13, 1990. U.S. Pat. No. 4,602,390, issued to Ignacio G. Morera et al. on Jul. 29, 1986, shows a pocket that attaches to and detaches from either the inside or the outside of an article of clothing. U.S. Pat. No. 4,365,355, issued to Joseph W. A. Off et al. on Dec. 28, 1982, shows a pocket that is attached by an adhesive and optionally stitched to the outside of an article of clothing.

U.S. Pat. No. 5,468,152 issued on Nov. 21, 1995, to Mary K. Lenart describes an educational children's clothing having pockets of various shapes decorated with educational concepts such as the alphabet, geometry, the number system, color, modes of transportation, nature, and zoology. The pockets are distinguishable for lacking magnetic means.

None of the above patents, taken either singly or in combination, describe a pocket that can be repeatedly attached to and detached from an article, wherein the pocket is affixed to the article by magnets. Additionally, none of the above patents describe a detachable pocket having dual pouches, one inside and one outside an article. Further, none of the above patents describe a detachable pocket having theme related accessories. Likewise, none of the above patents, taken either singly or in combination, is seen to describe the instant invention as claimed.

SUMMARY OF THE INVENTION

The present invention is a pocket using opposing magnetic strips that can be repeatedly attached to and detached from either the inside or the outside of a clothing apparel article having a thin sheet wall such as a piece of clothing, a hat, a portable bag, or decorative articles like holiday stockings. The detachable pocket includes a pair of fabric patches including strip magnets that are sewn into a hem around most of the periphery of each patch, forming a backless pouch. Each magnetized pouch so formed can thus be placed on opposing sides of the article and thereby form a detachable pouch on the inside and on the outside of the article.

An alternative embodiment has a pocket pouch only on the outside of the article with a U-shaped magnetic member holding the outside pouch from the inside of the article. The outside pouch can include theme related attachments in various embodiments of the detachable pocket such as bells and lace for a Christmas theme. Additionally, the pattern for the fabric from which the outside pouch of the detachable pocket is constructed displays a theme in some embodiments.

Accordingly, it is a principal object of the invention to provide a pocket that is attachable to and detachable from an article having a thin sheet wall, wherein the detachable pocket is affixed to the thin wall by magnets attracted to one another through the wall.

It is another object of the invention to provide a detachable pocket that has opposing pouches on both the inside and on the outside of the article to which the detachable pocket is affixed.

It is a further object of the invention to provide a detachable pocket that has visible theme related decorative attached elements.

Still another object of the invention is to provide a detachable pocket constructed from a fabric that displays a theme related pattern.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
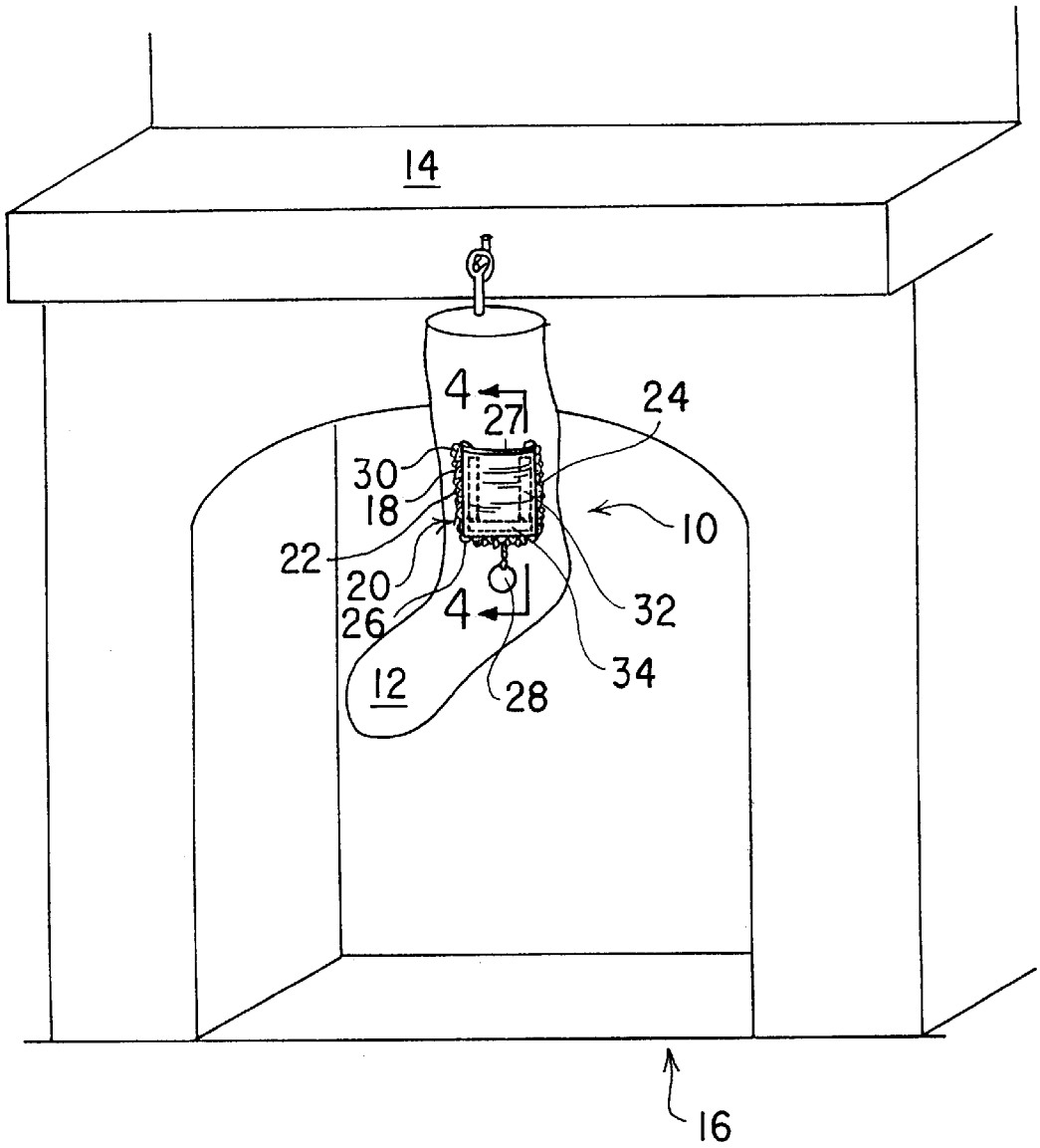
FIG. 1 is an environmental, perspective view of a magnetic detachable pocket affixed to a holiday stocking as a first embodiment according to the present invention.

The present invention is a pocket that may be repeatedly attached to and detached from an article such as a piece of clothing, a hat, a portable bag or a decorative stocking. FIG. 1 shows the detachable pocket 10 affixed to a Christmas stocking 12 that hangs from a mantle 14 above a fireplace 16. Decorative lace 18 is attached to a left edge 22, a right edge 24, a bottom edge 26, and a top edge 27 of an outside pouch 20. A bell 28 hangs from the bottom edge 26 of the outside pouch 20. The bell 28 and the lace 18 are sewn to the material from which the outside pouch 20 is fabricated.

In the preferred embodiment of the detachable pocket 10 for use with a Christmas stocking 12, the material from which the outside pouch 20 is fabricated displays a pattern related to the Christmas holiday theme. Other embodiments of the detachable pocket 10 designed for use on other occasions have an outside pouch 20 fabricated from a material that displays a pattern related to a specific theme for that occasion.

A left outside magnet 30, a right outside magnet 32, and a bottom outside magnet 34 are shown in silhouette or shadow lines. The left outside magnet 30 is disposed along the left edge 22 of the outside pouch 20. The right outside magnet 32 is disposed along the right edge 24 of the outside pouch 20. The bottom outside magnet 34 is disposed along the bottom edge 26 of the outside pouch 20.

Figure 2:
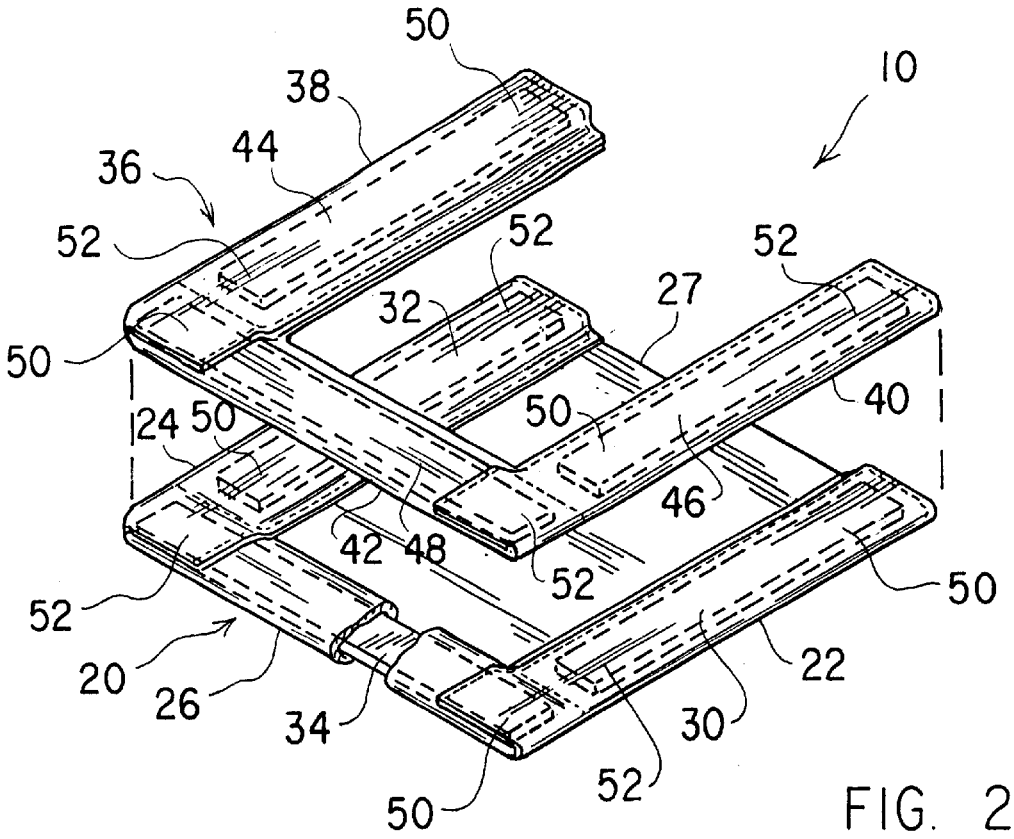
FIG. 2 is an exploded, partially fragmented, perspective view of the magnetic detachable pocket of the FIG. 1 embodiment according to the present invention.

Greater detail regarding the left outside magnet 30, the right outside magnet 32, and the bottom outside magnet 34 are illustrated in the detachable pocket 10 shown exploded in FIG. 2. A U-shaped member or inside support 36 is shown facing the outside pouch 20. The inside support 36 has a tubular left inside member 38, a tubular right inside member 40, and a tubular bottom inside member 42. The left inside member 38 is located in registry with the right edge 24 of the outside pouch 20. The right inside member 40 is located in registry with the left edge 22 of the outside pouch 20. The bottom inside member 42 is located in registry with the bottom edge 26 of the outside pouch 20. A left inside magnet 44 is sewn inside the tubular left inside member 38. A right inside magnet 46 is sewn inside the tubular right inside member 40. A bottom inside magnet 48 is sewn inside the tubular bottom inside member 42.

The magnets 30, 32, 34, 44, 46, and 48, each have a positive pole 50 and a negative pole 52. The inside magnets 44, 46 and 48 are aligned so that the negative poles 52 of the inside magnets 44, 46 and 48 mate with the positive poles 50 of the outside magnets 30, 32 and 34 with which the inside magnets 44, 46 and 48 are in registry. In this manner, the inside support 36 firmly mates with the outside pouch 20, thus securing the outside pouch 20 in place by the magnetic attraction through a thin sheet wall of an article.

Using the example of the Christmas stocking 12, the inside support 36 is slipped inside the stocking 12 until it is in registry with the outside pouch 20. Thus, the layer of the Christmas stocking 12 facing out is sandwiched between the inside support 36 and the outside pouch 20 when the detachable pocket 10 is secured in place. Similarly, the detachable pocket 10 is secured to a hat, an article of clothing, a portable bag or any other like article. The detachable pocket 10 of the present invention operates properly with any article through which the magnetic field can penetrate to effect the mating of the outside pouch 20 to the inside support 36. It should be apparent that the same result can be achieved in an embodiment with the polarity reversed.

In all of the above mentioned embodiments of the present invention, the top edge 27 of the outside pouch 20 remains unobstructed by virtue of the lack of magnets while the outside pouch 20 is securely mated with the inside support 36. Thus, when the outside pouch 20 is securely mated with the inside support 36, the outside pouch 20 functions in exactly the same manner as the common patch style pocket. Articles are placed within and removed from the outside pouch 20 at will.

The fundamental difference, however, between the present invention and the common patch style pocket is that the elements of the present invention are fully detachable. One important benefit of the present invention not available in any other detachable pocket currently known in the art is that the present invention does not require any receiving means, such as snap bases, hook or loop patches, or adhesive strips, to be permanently affixed upon the article to which the detachable pocket 10 is affixed. In this manner the present invention places a detachable pocket upon an article without any observable alteration in the receiving article itself, an objective not previously accomplished in the art.

Figure 3:
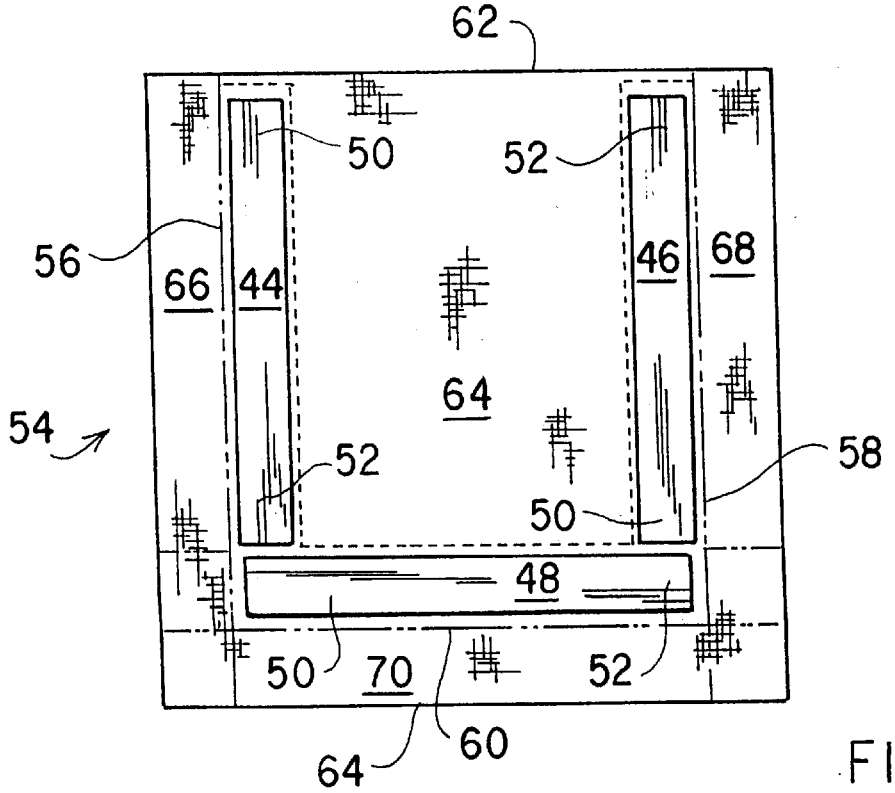
FIG. 3 is a plan view of a second embodiment of the present invention wherein an inside pouch is substituted for the inside support with the pouch fabric laying flat under three magnets prior to sewing.

Turning to FIG. 3, as a second embodiment of the present invention an inside pouch 54 is substituted for the inside support 36. Like the outside pouch 20, the inside pouch 54 has a left side 56, a right side 58, a bottom side 60, and a top side 62. The basic difference distinguishing the inside pouch 54 from the inside support 36, is that the material from which the inside pouch 54 is fabricated extends between the left side 56 and the right side 58 such that the inside pouch 54 is a mirror image of the outside pouch 20 in the preferred embodiment. Otherwise the inside pouch 54 is the same as the inside support 36. That is, the left side 56, the right side 58, and the bottom side 60 of the inside pouch 54 are tubular and contain a left inside magnet 44, a right inside magnet 46, and a bottom inside magnet 48, respectively, in mating opposition to the magnets 30, 32, and 34 of the outside pouch 20. Thus, in the preferred embodiment, the outside pouch 20 is visible from the exterior and the inside pouch 54 is hidden.

Like the inside support 36, the inside pouch 54 is slipped inside the stocking 12 or other article until the inside pouch 54 is in registry with the outside pouch 20. Thus, a layer facing outwardly on the Christmas stocking 12 or other article to which the detachable pocket 10 is attached is sandwiched between the inside pouch 54 and the outside pouch 20 when the detachable pocket 10 is secured in place. Like the outside pouch 20, the inside pouch 54 functions in exactly the same manner as the common patch style pocket. Articles are placed within and removed from the inside pouch 54 at will through the top side 62 of the inside pouch 54 which is unobstructed when the inside pouch 54 is mated with the outside pouch 20.

Having an inside pouch 54 in registry with an outside pouch 20 provides an added advantage by providing a hiding place for valuable items on one's body. By placing valuable items in the inside pouch 54 and non-valuable items in the outside pouch 20, if a thief resorts to frisking his victim and discovers the presence of items at the location of the detachable pocket 10, the thief will probably only recover the contents of the outside pouch 20, because it is unlikely that the thief would think to refrisk an article after recovering the non-valuable contents of the outside pouch 20.

Referring to FIG. 3, an inside pouch 54 is shown during fabrication. The left inside magnet 44, the right inside magnet 46, and the bottom inside magnet 48 are placed on top of a piece of material 64 of a predetermined shape. A bottom flap 70 of the piece of material 64 is folded over the bottom inside magnet 48 along the bottom side 60, represented here as a fold line. The edge of the bottom flap 70 is then sewn with the stitching passing between the left inside magnet 44, the right inside magnet 46, and the bottom inside magnet 48. In this manner the tubular portion of the bottom side 60 is partially sealed, by stitching above the bottom inside magnet 48, and by the fold at the bottom side 60 below the bottom inside magnet 48.

Next, a left flap 66 of the piece of material 64 is folded over the left inside magnet 44 along the left side 56 with the left side 56 also represented here as a fold line. Similarly, a right flap 68 of the piece of material 64 is folded over the right inside magnet 46 along the right side 58, represented as a fold line. These folds, forming the right side 58 and the left side 56, seal the remaining parts of the tubular portion of the bottom side 60 and form the outside edges of the tubular portions of the left side 56 and right side 58. The tubular portions of the left side 56 and the right side 58 are then completed by sewing the left flap 66 and the right flap 68 above, inside, and below the left inside magnet 44 and the right inside magnet 46.

Figure 4:
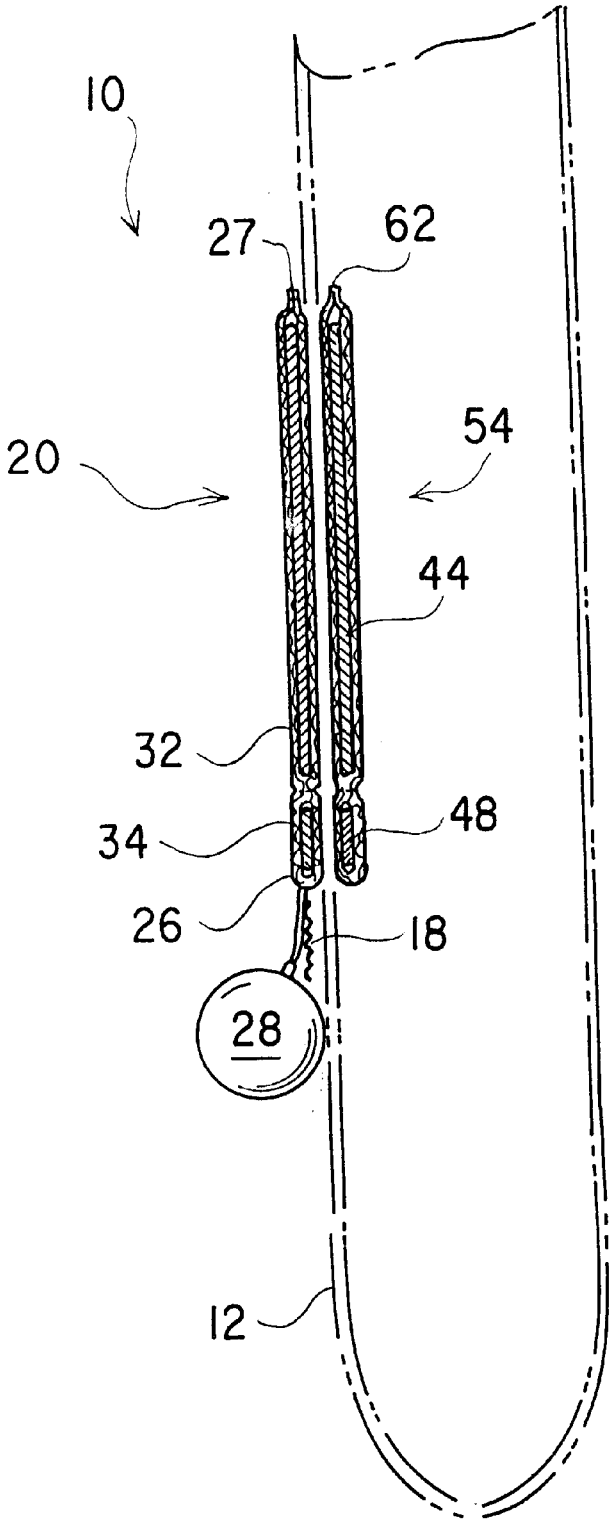
FIG. 4 is a sectional view of a magnetic detachable pocket along line 4—4 in FIG. 1, according to the present invention.

The procedure for making the outside pouch 20 and the inside support 36 follow the same steps described here for making the inside pouch 54. FIG. 4 provides an additional view of the elements of the preferred embodiment of the detachable pocket 10 for use with a Christmas stocking 12. Furthermore, in another alternative embodiment of the detachable pocket 10 a transparent material for the outer pouch 20 can be used, thus making the contents of the outer pouch 20 visible from without. Another embodiment can incorporate the use of audible sounds or words to enhance the detachable pocket 10.

It is to be understood that the present invention is not limited to the embodiments described above, but encompasses any and all embodiments within the scope of the following claims.

We claim:

1. A magnetic detachable pocket comprising:

an outside pouch portion having a left edge, a right edge, and a bottom edge;

a left outside magnet disposed along the left edge;

a right outside magnet disposed along the right edge;

a bottom outside magnet disposed along the bottom edge;

an inside pouch portion having a left side, a right side, and a bottom side, the inside pouch portion being substantially the same shape and dimension as the outside pouch portion;

a left inside magnet disposed along the left side of the inside pouch portion and being in registry with the right outside magnet and having opposing poles aligned to mate with the right outside magnet;

a right inside magnet disposed along the right side of the inside pouch portion and being in registry with the left outside magnet and having opposing poles aligned to mate with the left outside magnet; and a bottom inside magnet disposed along the bottom side of the inside pouch portion in registry with the bottom outside magnet and having opposing poles aligned to mate with the bottom outside magnet.

2. The magnetic detachable pocket according to claim 1, further comprising a bell hanging from the bottom outside edge.

3. The magnetic detachable pocket according to claim 1, further comprising lace extending from the left outside edge, the right outside edge, and the bottom outside edge.

4. The magnetic detachable pocket according to claim 1 wherein the outside pouch portion displays a pattern related to a theme.

5. The magnetic detachable pocket according to claim 4 wherein the outside pouch portion displays a pattern related to Christmas.

6. The magnetic detachable pocket according to claim 1 wherein the outside pouch portion is transparent.

7. A magnetic detachable pocket comprising:

an outside pouch portion having a left edge, a right edge, and a bottom edge;

a left outside magnet disposed along the left edge;

a right outside magnet disposed along the right edge;

a bottom outside magnet disposed along the bottom edge;

an inside support having a tubular left inside member in registry with the right outside edge, a tubular right inside member in registry with the left outside edge, and a tubular bottom member in registry with the bottom outside edge;

a left inside magnet within the left inside member, the left inside magnet having opposing poles aligned to mate with the right outside magnet;

a right inside magnet within the right inside member, the right inside magnet having opposing poles aligned to mate with the left outside magnet; and a bottom inside magnet within the bottom inside member, the bottom inside magnet having opposing poles aligned to mate with the bottom outside magnet.

* * * * *